US005558307A

United States Patent [19]

Klein et al.

[11] Patent Number: 5,558,307

[45] Date of Patent: Sep. 24, 1996

[54] GARMENT/TOWEL HOOK

[75] Inventors: Richard B. Klein, Overland Park; Chris Serslev, Leawood, both of Kans.; Ristomatti Ratia, Chicago, Ill.

[73] Assignee: Lynk, Inc., Shawnee Mission, Kans.

[21] Appl. No.: 289,006

[22] Filed: Aug. 11, 1994

[51] Int. Cl.[6] ..... A47F 5/00

[52] U.S. Cl. ..... 248/309.1; 248/205.3; 248/304

[58] Field of Search ..... 248/309.1, 302, 248/303, 304, 205.3, 205.4, 222.1, 339; 211/16, 105.1; D6/315, 316, 317, 320, 323, 327, 411, 412; 223/DIG. 4

[56] References Cited

U.S. PATENT DOCUMENTS

| | | | |
|---|---|---|---|
| D. 60,640 | 3/1922 | Batts | D6/323 |
| 239,465 | 3/1981 | Delany . | |
| D. 281,838 | 12/1985 | Thompson | D6/323 |
| D. 301,807 | 6/1989 | Friedman | D6/323 |
| 1,086,200 | 2/1914 | Michie | 211/16 X |
| 1,235,159 | 7/1917 | Recker . | |
| 1,305,560 | 6/1919 | Okamoto | D6/323 |
| 1,377,444 | 5/1921 | Shoemaker | 248/304 X |
| 2,504,910 | 4/1950 | Wellington . | |
| 3,185,427 | 5/1965 | Peras . | |
| 3,637,084 | 1/1972 | Uitz | 211/105.1 |
| 4,094,030 | 6/1978 | Saad | D6/315 X |
| 4,760,912 | 8/1988 | Vaida . | |
| 4,920,983 | 5/1990 | Jimenez et al. . | |
| 4,944,480 | 7/1990 | Jarrett . | |
| 4,974,286 | 12/1990 | Stowell et al. . | |

FOREIGN PATENT DOCUMENTS

| | | | |
|---|---|---|---|
| 354729 | 9/1905 | France | 248/304 |

*Primary Examiner*—Ramon O. Ramirez
*Assistant Examiner*—Korie H. Chan
*Attorney, Agent, or Firm*—Kokjer Kircher Bowman and Johnson

[57] ABSTRACT

A hook for hanging clothing, towels or other articles. The hook includes an enlarged rigid base secured to a wall or other vertical surface. A rigid rod extends from the base to a free end having a reduced diameter. A friction knob is mounted upon this reduced diameter section. The friction knob takes the form of a sheath which surrounds the free end of the rod. A plurality of circumferential ribs extend from the exterior of the sheath at locations spaced along its longitudinal axis. The free ends of the ribs are arranged along the axis such that the ribs, and thus the exterior of the knob, take an ellipsoidal form having a relatively large size. This relatively large size reduces wrinkling and "bulging" in the article hung upon the hook. The knob is formed of a flexible material having a relatively high coefficient of friction. The weight of the article will typically deform the ribs, increasing the surface area of the knob material in contact with the knob, and thus reducing the possibility of the article slipping from the knob. The rod is hollow, with a hole extending through the base. A screw is inserted through the hole to secure the hook to the wall. A cosmetic plug is attached to the free end of the rod to hide the screw. The plug also acts as an enlarged head to maintain the knob upon the rod.

6 Claims, 1 Drawing Sheet

GARMENT/TOWEL HOOK

BACKGROUND OF THE INVENTION

1. Field of the Invention

The present invention relates in general to hooks for hanging garments, towels, etc. In particular, the present invention relates to an improved hook of this type having increased retention and reduced garment wrinkling and "bulging".

2. Description of the Related Art

Hooks for hanging clothing, towels, etc. have a very long history. Typical hooks have a general shape of a cantilevered rod, usually angled upward. The free end of the rod is commonly rounded to reduce damage to the article hung upon the hook.

Several common problems exist with such hooks. First, the articles hung upon the hooks have a tendency to slide off of the hook. To overcome this problem it has been known to provide the free end with an elastic cover to increase friction, as shown in U.S. Pat. No. 239,465 to Delany. Another solution has been to provide knurling or an adhesive substance on the free end, as proposed in U.S. Pat. No. 4,944,480 to Jarrett.

The second main problem has been that the article hung upon the hook may become wrinkled due to the folds induced in the article during hanging. Again, one solution proposed in the above-noted patent to Jarrett is to provide a large diameter bulb on the free end of the hook.

A further problem is the amount of pressure applied to the fabric of the article at the hook, due to the weight of the article. Undue pressure can produce "bulges" in the fabric, or in some loose-weave fabrics, the hook can actually pass through the article, damaging the weave.

SUMMARY OF THE INVENTION

An object of the present invention is to provide a hook for clothing, towels or other articles, which securely retains the article on the hook.

Another object of the present invention is to provide a hook for clothing, towels or other articles, which reduces or eliminates wrinkling in the article on the hook.

A further object of the present invention is to provide a hook for clothing, towels and other articles which applies minimum pressure to the fabric to reduce or eliminate the damage to the fabric.

Another object of the present invention is to provide such a hook which is aesthetically pleasing.

A further object of the present invention is to provide a hook arrangement which permits secure and simple screw attachment to a wall without the screw being visible.

These and other objects are achieved by a hook for hanging clothing, towels or other articles. The hook includes an enlarged rigid base adapted to be secured to a wall or other vertical surface. A rigid rod extends from the base to a free end having a reduced diameter. A friction knob is mounted upon this reduced diameter section. The friction knob takes the form of a sheath which surrounds the free end of the rod. A plurality of circumferential ribs extend from the exterior of the sheath at locations spaced along its longitudinal axis. The free ends of the ribs are arranged along the axis such that the ribs, and thus the exterior of the knob, take an ellipsoidal form having a relatively large size. This relatively large size reduces wrinkling and "bulging" in the article hung upon the hook. The knob is formed of a flexible material having a relatively high coefficient of friction. The weight of the article will typically deform the ribs, increasing the surface area of the knob material in contact with the knob, and thus reducing the possibility of the article slipping from the knob. To increase ease of attachment, the rod may be hollow, with a through hole extending through the base. A screw may be inserted into the rod and through the hole to secure the hook to the wall. A cosmetic plug may then be attached to the free end of the rod, as by a friction fit, to hide the presence of the screw. The plug may also act as an enlarged head to maintain the knob upon the rod.

BRIEF DESCRIPTION OF THE DRAWINGS

The objects and features of the invention noted above are explained in more detail with reference to the drawings, in which like reference numerals denote like elements, and in which.

DETAILED DESCRIPTION OF THE INVENTION

Figure 1:
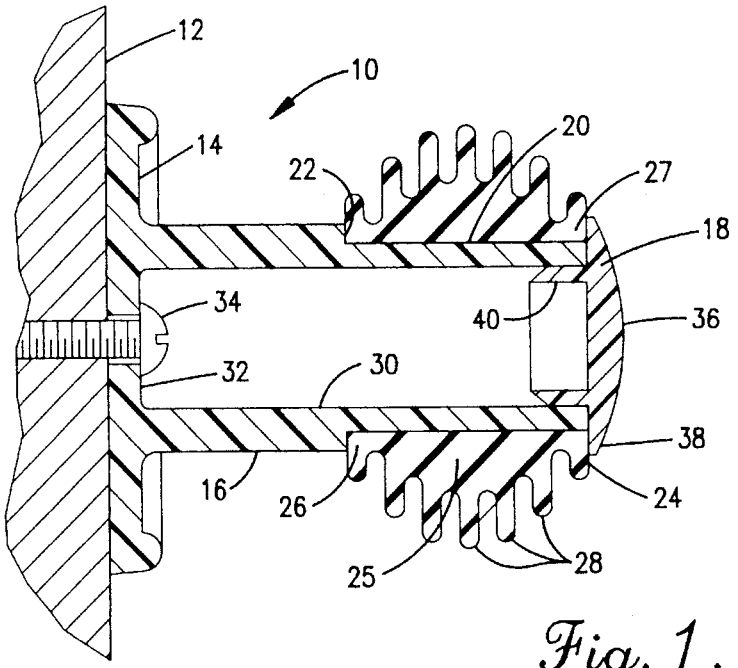
FIG. 1 is a cross-sectional side view of a hook according to the present invention.
Figure 2:
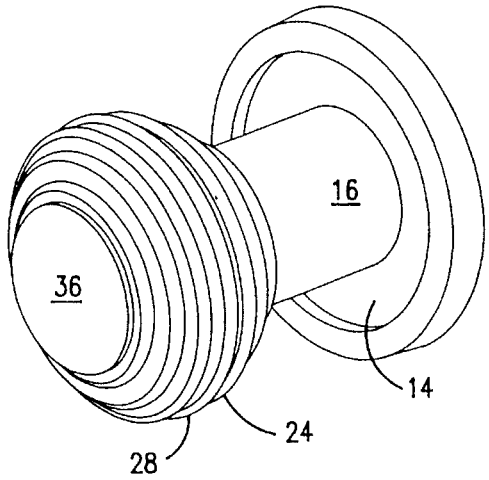
FIG. 2 is a perspective view of the hook of FIG. 1.

With reference to FIG. 1, a first embodiment of a hook according to the present invention is generally designated by reference numeral 10. The hook 10 is intended to be mounted upon a vertical surface 12, such as a wall, door, etc. The hook includes a rigid base 14, with at least a portion of the base to be placed in abutment with the surface 12. The base is typically a generally planar member (at least on its rear face), and may have a variety of peripheral configurations. As best shown in FIG. 2, a circular configuration is preferred for this first embodiment.

Other, non-planar,, base configurations are of course possible. Various curved bases may be used for specialty applications for curved surfaces. Furthermore, the base may take the form of an inverted "J", such that it may be hung from the upper edge of a door, as is known in the art.

Rigidly extending from the base 14 is a cantilevered rod 16, which has a free end 18. The rod 16 will have a cross-sectional peripheral length less than that of the base 14. In other words, the rod is smaller than the base when viewed along the length of the rod. In the embodiment shown, the rod has a circular cross-sectional configuration, and the diameter (and thus the peripheral length) of the rod is less than that of the base. This will result in at least some portion of the base extending radially outward beyond the periphery of the rod. This portion will be located vertically above or below the rod when the hook 10 is attached to the surface 12, such that that portion of the base acts to support the rod in its cantilevered position by placing pressure upon the surface 12. In the embodiment shown, the rod is centered within the periphery of the base, and this is the preferred arrangement, as no alignment is required during attachment to the surface 12.

In the embodiment shown, the rod 16 extends substantially normal to the surface 12. Due to the remaining structure of the hook 10, described below, this is an acceptable arrangement. The rod could take angled configurations if desired, however. In particular, the typical upward cant of hooks may be applied to the rod, although a slight downward angle, or angles toward either side, will still provide acceptable results.

As noted above, the rod 16 is rigidly secured to the base 14. In the preferred embodiment, this is achieved by forming the base and rod as a monolithic unit using plastic, wood or metal. Integral arrangements are also possible, such as the base being formed of wood and the rod being formed of metal, such as brass. In such a situation the rod will be appropriately secured to the base, as by adhesives, fasteners, etc.

As shown in FIG. 1, the rod 16 includes a mounting portion 20 adjacent to, and encompassing, the free end 18. The mounting portion is formed by removal of at least a portion of the thickness of the rod, such that a longitudinally outward-facing shoulder 22 is formed at the interior end of the mounting portion 20. As may be envisioned, this may be achieved in numerous ways. For example, one or more flats may be formed on the surface of the mounting portion, with the shoulder being formed at the interior end of each flat. Alternatively, one or more grooves could be formed in the outer surface of the mounting portion, again with the interior end of each groove forming the shoulder. Such grooves could of course have various cross-sectional configurations.

In the preferred embodiment shown in FIG. 1, the mounting portion has a peripheral configuration similar to, but a peripheral length less, than, the remainder of the rod 16. In particular, the mounting portion has a diameter less than that of the remainder of the rod, and is centered with respect to the remainder of the rod, such that the shoulder 22 extends about the entire periphery of the rod 16.

The mounting portion 22 serves to mount a knob 24. The knob 24 includes a sheath 25 in the general form of a cylinder having a first open end 26 and a second end 27. The interior of the sheath is generally cylindrical and has a diameter such that it may be closely received upon the mounting portion 22. In all cases this diameter should allow the sheath to be placed upon the mounting portion by sliding from the free end of the mounting portion inward. While the diameter may be such that the friction between the sheath and the mounting portion retains the knob in position, the diameter may be made greater such that the knob may be easily removed. If the knob may be easily removed, there must be provided some arrangement to maintain the knob on the mounting portion, as discussed more fully below.

The exterior of the sheath may take various configurations, such as cylindrical or spherical. In the preferred embodiment, the exterior takes the form of an ellipsoid having its minor axis as the axis of revolution and with this minor axis aligned with the longitudinal axis of the mounting portion. As is best shown in FIG. 1, this ellipsoid may be truncated, due to the presence of the interior cavity of the sheath.

Extending from the exterior of the sheath are a plurality of ribs 28. As is best shown in FIG. 1, the ribs extend radially outward from the longitudinal axis of the rod, and therefore from the minor axis of the ellipsoid of the sheath, and are spaced along these same axes. The ribs 28 have free ends at their radially outward extent. The distance from the sheath to the free end (i.e., the length of the rib) is preferably constant about the angular extent of the sheath. Further, this distance is preferably such that the free ends of the ribs together form an ellipsoid as discussed above. In the embodiments shown, with the ellipsoidal sheath exterior, this means that the length of the ribs is substantially equal (at least for the longitudinally interior ribs) and the sheath configuration is carried over into the free ends of the ribs. Alternatively, the rib lengths could be varied to provide the ellipsoidal configuration.

The knob 24 formed of the sheath and ribs is typically constructed as a monolithic unit. The knob, and at least the ribs, is formed of a material which is resilient and has a relatively high coefficient of friction with textiles. A preferred material is Santoprene® elastomer, available from Monsanto.

As may be envisioned, a hook as described above will provide excellent characteristics for clothing, towels, etc. In particular, the relatively large "diameter" of the ellipsoidal knob will reduce wrinkling and "bulging" of the garment. To ensure that the garment is retained on the hook, the relatively high friction comes into play. Further, the flexible ribs will flex under a sufficient load to reduce wrinkling, and to increase the surface area in contact with the garment to reduce "bulging", etc. This increase in surface area in contact will of course increase the friction, to automatically provide increased retention forces for those object which require it. Finally, the ellipsoidal rib configuration is aesthetically pleasing.

As noted above, the friction of the knob 24 may be employed to retain the knob upon the mounting portion 20 of the rod 16. Where this is the case, the outer end of the knob may be closed, such that the interior of the sheath is a blind hole. However, it is preferred that the hole in the sheath extend fully therethrough, such that the rod 16 is accessible from the outer end of the knob, as shown in the figures.

With either configuration it is preferred that the rod be formed with a stepped cavity 30 extending therethrough, such that an outwardly facing shoulder 32 is formed in the cavity adjacent the rear end of the rod. In this manner, a fastener, such as a screw 34, may be partially passed through the cavity to engage the surface 12, yet have its enlarged head abutting against the shoulder 32. The fastener will therefore hold the hook firmly in position on the surface 12.

If the knob 24 is formed with a closed forward end, this closed end will block access to cavity 30. As such, it is necessary to remove the knob in order to have access to mount or remove the hook from the surface 12. However, the closed end of the knob will cover the cavity 30 at all other times, providing a pleasing appearance to the hook.

To increase the security of the fastener (and thus reduce unauthorized removal of the hook), and to further increase the pleasing appearance of the hook, it is preferred, however, that the knob 24 have an open front end as shown in the figures. To obscure and protect the cavity and fastener, there is provided a cap 36. As is shown in FIG. 1, the cap 36 includes a head 38 and a skirt 40. The skirt 40 is sized to be received within the cavity 30 with a close fit, such that it is frictionally retained. Alternatively or additionally, the skirt may be secured by adhesives, threads, thermal bonding, etc. The head 38 is of a larger diameter, and preferably extends radially outward of the mounting portion to thus form an abutment or shoulder preventing removal of the knob.

In a manner similar to that noted above, the cap is removed during mounting and removal of the hook, to permit access to the fastener 34. At all other times the cap prevents such access, increases the aesthetics of the hook, and prevents removal of the knob 24.

Figure 3:
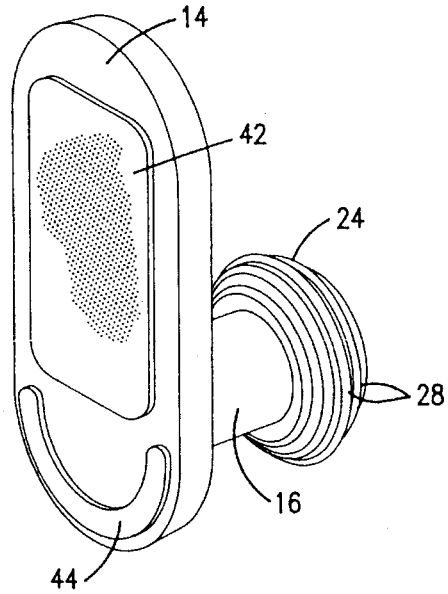
FIG. 3 is a rear perspective view of a second embodiment of a hook according to the present invention.

It should be apparent that other arrangements for mounting the hook are possible. For example, there may be provided a plurality of holes through the base 14 radially exterior of the rod 16, with each hole receiving a fastener. Alternatively, the base may be adhesively secured to the surface 12. An alternative embodiment using adhesives is shown in FIG. 3.

In this second embodiment, there is shown a pad of pressure sensitive adhesive 42 on the rear face of the base 14. The base has been elongated in a direction corresponding to vertical when mounted. This elongation will provide increased support in the direction receiving the most stress during use of the hook. While FIG. 3 shows the elongation directed upward, it could alternatively or additionally be directed downward. The rear face of the base may include a raised pressure area 44 of the same material as the base 14. The raised pressure area has a height similar to that of the adhesive pad 42, and as such will abut against the surface 12 and provide a more rigid support.

From the foregoing it will be seen that this invention is one well adapted to attain all ends and objects hereinabove set forth together with the other advantages which are obvious and which are inherent to tile structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

What is claimed is:

1. A garment/towel hook, comprising:

a base for abutment against a vertical surface;

a cantilevered rod extending from said base and having a free end;

a knob mounted upon said rod adjacent said free end, said knob including a tubular sheath, having an opening extending therethrough along a longitudinal axis of said sheath, said opening slidably received on said free end of said rod, said sheath being integrally formed with a plurality of ribs extending thereabout, and projecting radially outward from the longitudinal axis of said sheath and from a longitudinal axis of said rod, said ribs being spaced along said sheath, said ribs being formed of a resilient material having a relatively high coefficient of friction.

2. The garment/towel hook as in claim 1, wherein said rod includes a mounting portion adjacent to and encompassing said free end, said mounting portion defining an outwardly facing shoulder, and wherein an interior end of said knob abuts against said shoulder.

3. The garment/towel hook as in claim 2, wherein said rod includes a cavity therein opening onto said free end, and further including:

a cap, said cap having a skirt received within said cavity, and a head extending outward from said longitudinal axis a distance greater than said mounting portion, whereby said head forms an abutment resisting removal of said knob.

4. The garment/towel hook as in claim 3, wherein said cavity includes a longitudinally outward facing shoulder adjacent said base, and a through hole opening onto a longitudinally interior end of said rod and said base, whereby a screw extends through said through hole to secure said hook to said surface.

5. The garment/towel hook as in claim 4, wherein said ribs define an ellipsoidal configuration having a minor axis as an axis of revolution and aligned with said longitudinal axis of said rod.

6. The garment/towel hook as in claim 1, wherein said ribs define an ellipsoidal configuration having a minor axis as an axis of revolution and aligned with said longitudinal axis of said rod.

* * * * *